United States Patent [19]

Lamar

[11] Patent Number: 5,018,629

[45] Date of Patent: May 28, 1991

[54] SCAFFOLDING RACK

[76] Inventor: Robert Lamar, A-4350 - 64th St., Holland, Mich. 49423

[21] Appl. No.: 433,290

[22] Filed: Nov. 8, 1989

[51] Int. Cl.[5] ..... A47B 47/00

[52] U.S. Cl. ..... 211/194; 108/53.1; 108/55.1; 211/49.1

[58] Field of Search ..... 211/50, 49.1, 194; 108/53.1, 53.3, 53.5, 55.1, 55.3, 51.1, 51.2; 206/499, 511, 386

[56] References Cited

U.S. PATENT DOCUMENTS

| | | | |
|---|---|---|---|
| 289,825 | 12/1883 | Fulton | 211/50 |
| 1,912,864 | 6/1933 | Stannard . | |
| 2,322,748 | 6/1943 | Shaw et al. . | |
| 2,801,752 | 8/1957 | Jakubowski | 211/49.1 |
| 2,940,402 | 6/1960 | Hansen et al. . | |
| 2,940,597 | 6/1960 | Machielse et al. . | |
| 3,107,024 | 10/1963 | Johnson et al. | 108/53.5 X |
| 3,193,093 | 7/1965 | Hansen | 108/53.1 X |
| 3,502,227 | 3/1970 | Konstant et al. | 211/194 |
| 3,937,329 | 2/1976 | Hammerel . | |
| 4,013,256 | 3/1977 | Hill | 211/49.1 X |
| 4,191,112 | 3/1980 | Maldonado | 211/194 X |
| 4,270,661 | 6/1981 | Rosenband . | |
| 4,295,431 | 10/1981 | Stavlo | 108/55.1 |
| 4,368,675 | 1/1983 | Propst et al. | 211/194 X |
| 4,773,547 | 9/1988 | Bell . | |
| 4,901,650 | 2/1990 | Armstead | 108/55.1 |

FOREIGN PATENT DOCUMENTS

| | | | |
|---|---|---|---|
| 2238410 | 2/1975 | France | 211/41 |
| 1008928 | 11/1965 | United Kingdom | 108/53.3 |
| 2028268 | 3/1980 | United Kingdom | 211/194 |

OTHER PUBLICATIONS

1988 Fall Catalog of Armstead Masonry Supply.

*Primary Examiner*—David L. Talbott
*Assistant Examiner*—Daniel Hulseberg
*Attorney, Agent, or Firm*—Price, Heneveld, Cooper, DeWitt & Litton

[57] ABSTRACT

A storage rack assembly for scaffolding components which include a number of features for storing a large variety of components necessary for scaffolding including the side frames, the braces for connecting and supporting the side frames, the base plates to be mounted under the legs of the scaffolding and blocking. The structure permits the convenient and easy removal of the components as the scaffolding is being erected and also the storing of the components when the scaffolding is being dismantled. The structure preferably includes four corner posts, the two front posts being spaced a distance less than the two rear posts, and support members for supporting the frame on an incline so as to provide a means to prevent the side frames from sliding off the rack. A unique and convenient structure for holding and permitting the removal and placement of the braces for connecting the side frames is provided along with a bin for supporting base plates and other blocking.

15 Claims, 3 Drawing Sheets

FIG. 6
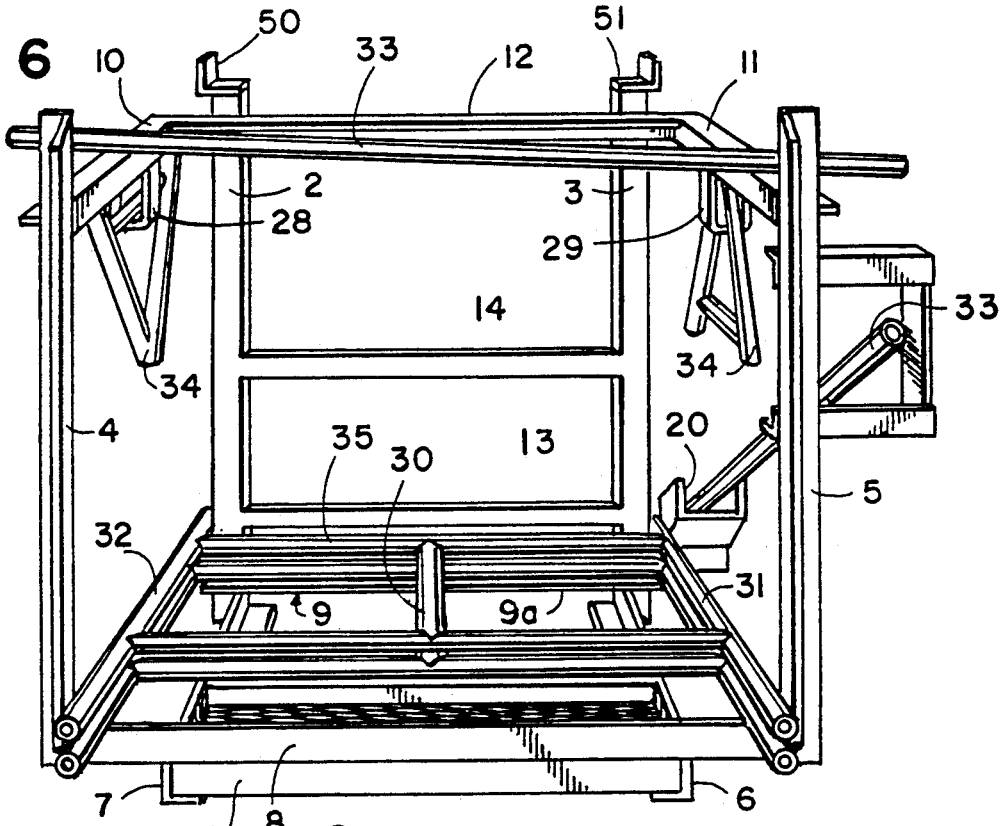
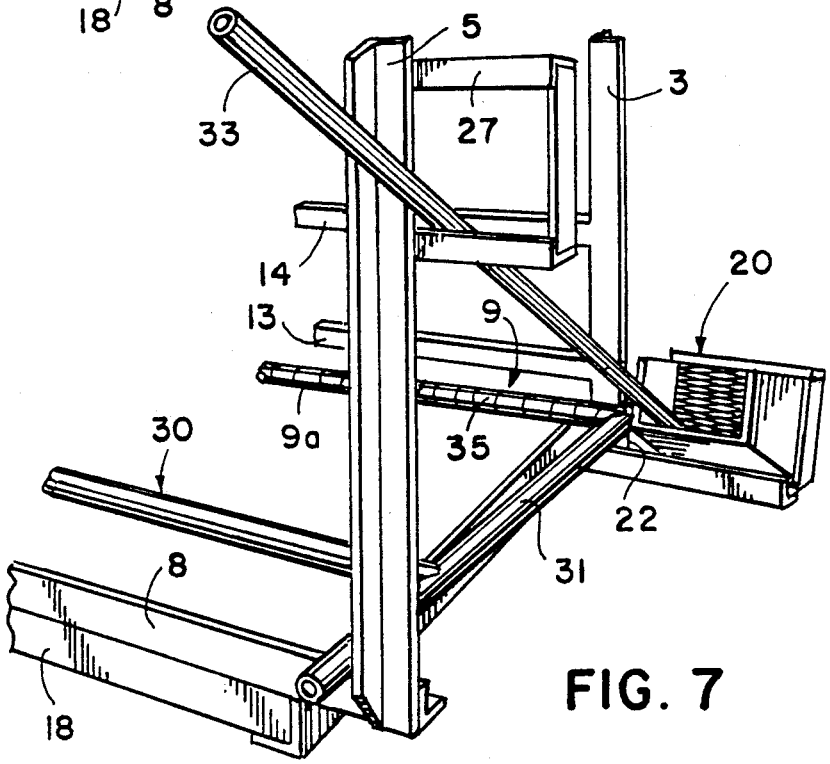
FIG. 7

FIG. 8
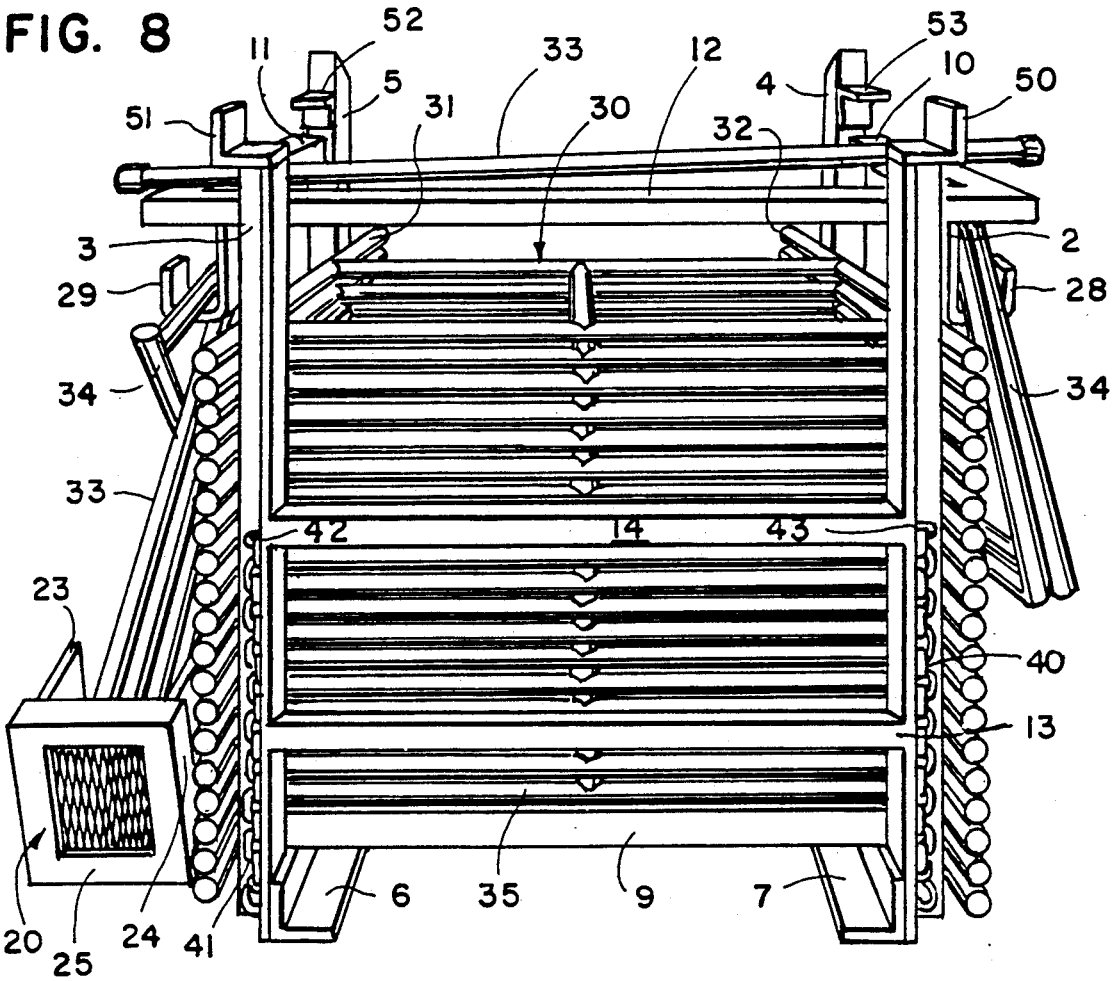
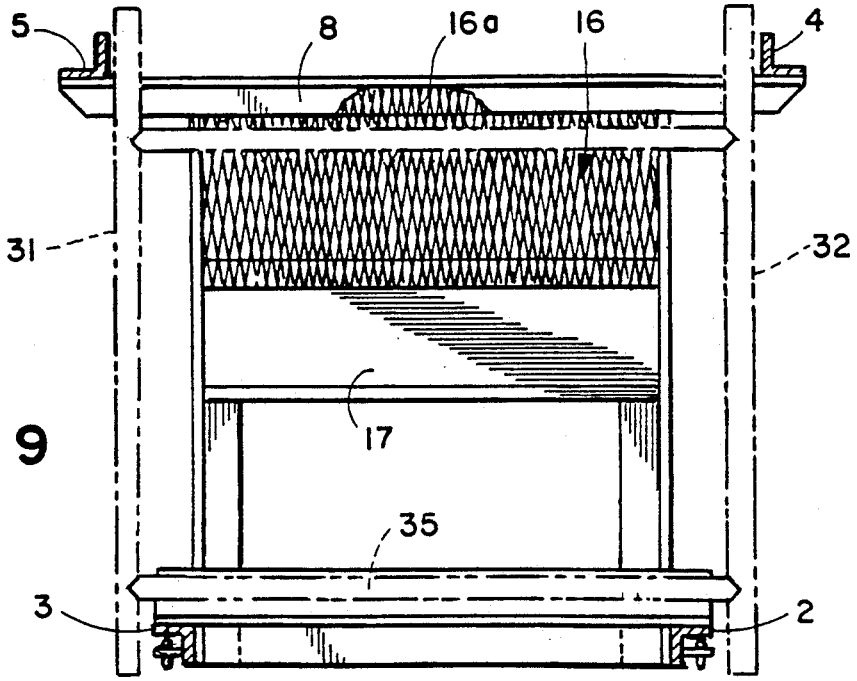
FIG. 9

SCAFFOLDING RACK

This invention relates to a scaffolding rack and particularly to a rack for holding and temporarily storing torn down scaffolding components, such as frames, braces and the like. More particularly, this invention relates to a rack for holding and storing scaffolding frames constructed of parallel spaced legs, the frames being stored on their sides and stacked one upon the other.

BACKGROUND OF THE INVENTION

The handling and storage of components for scaffolding which is used in the building trade, such as, for example, for laying brick, applying siding to the side of a building and painting, has always created a problem because such components are difficult to handle in an orderly manner during erection and dismantling and for storing. Efforts have been made for storing such components upon a rack which can be lifted to the desired level when the scaffolding is being erected or dismantled and this type of rack has made it possible to erect or dismantle right from the rack so that the components are handled once from tear down to erection.

Also, such racks have made it much easier to move the components from the yard where they are stored to the job and back.

One of the problems has been that the scaffolding, frames forming one part of the scaffold and constructed of two spaced legs connected together by braces, frequently had the tendency of sliding off the rack through an open end provided for easily removing the frames as the scaffolding is being erected.

Another problem has always been the storage of the elongated braces in a position from which they can be easily removed from the rack for connecting the two side frames together as the erection took place. Scaffolding is frequently erected on bare soil so that the legs of the scaffolding have a tendency to sink into the soil, thus disturbing the level of the scaffolding. As a result, base plates are placed on the soil under the scaffolding legs so as to eliminate the legs sinking into the soil. A problem has existed in the storage of such base plates on the same rack with the other components of the scaffolding so as to be accessible when needed.

The present invention provides an improved scaffolding rack which solves the above problems.

SUMMARY OF THE INVENTION

According to the present invention, there is provided a scaffolding rack assembly comprising four upright posts connected together at their lower and top ends by front, rear and end rails. Within one aspect of this invention, the two front posts are spaced a distance less than the spaced distance between the rear posts. The distances are selected to accommodate the spacings of the legs of the side frames of the scaffolding so that the legs extend on the outside of the front posts and on the inside of the rear posts. Further, the frame members on which the scaffolding is mounted are arranged so that the scaffolds are inclined and tend to slide toward the front posts. This construction provides a means of preventing the frames from sliding off the rack. The rack is generally supported by a fork which is also tipped slightly towards the front posts. Therefore, if the frames have any tendency to slide, they will slide toward the front posts which restrict the sliding action by reason of the braces or stringers extending between the two legs of the scaffolding frame. This arrangement permits the easy removal of the scaffolding frame through the opening provided by the rear posts which are spaced a distance greater than the front posts.

Within another aspect of this invention, I provide a means for storing the elongated support braces which are provided for securing the frames together as the erection of the scaffolding takes place. This storage means comprises a basket located at the lower front corner of the rack and slightly to one side thereof, with a ring-like holder of rectangular shape mounted adjacent the upper corner and on the same side as the basket. The braces are mounted with the lower end extending into the basket and the upper end extending through the ring-shaped holder so as to hold the braces at an angle with the top end closest to the person doing the erecting. As a result, the braces are readily accessible and can be easily removed by the worker erecting the scaffolding.

Another aspect of my invention is to provide a bin for the base plates at a position adjacent the rear posts. This bin extends a short distance towards the front and its front wall is formed so as to provide a stop for the fork of the lift tractor specifically for the purpose of preventing the lift tractor from striking the front braces of the rack as the fork is inserted under the rack for lifting the same. This bin preferably has a floor constructed of expanded metal which is a pervious material through which sand and other debris sticking onto the base plates can pass to minimize collection of debris in the bin.

Still another aspect of my invention is to provide support hooks mounted on the upper side support rails extending between the front and rear posts. These support hooks are for the purpose of supporting the scaffolding components such as triangular braces which in many instances are utilized on the scaffolding as a walk board support.

Still another aspect of my invention is to provide brackets at the tops of the posts which are configured and arranged to receive the bottoms of another identical rack to facilitate stacking of one rack on another.

As a result of the above construction which will be explained more detail hereinafter, I have provided a highly stable, versatile and convenient scaffolding rack which can be utilized on the site of a job as the scaffolding is being erected and also can conveniently be trucked back to a storage site for storing such components. This improved scaffolding rack will become more evident from the following description made in conjunction with the attached drawings.

BRIEF DESCRIPTION OF THE DRAWINGS

FIG. 6 is a front, elavational, perspective view of the rack of FIGS. 1, 2, 3 and 4 showing a few of each of the various components mounted thereon including side frames, braces, triangular braces and base plates;

FIG. 7 is a side, elevational, perspective view of one side of the rack showing in greater detail the storage of a support brace on the side of the rack;

FIG. 8 is another front, elevational, perspective view showing a large number of the scaffold components mounted on the rack; and FIG. 9 is a cross-sectional view of the rack taken along the plane IX—IX of FIG. 1.

Figure 1:
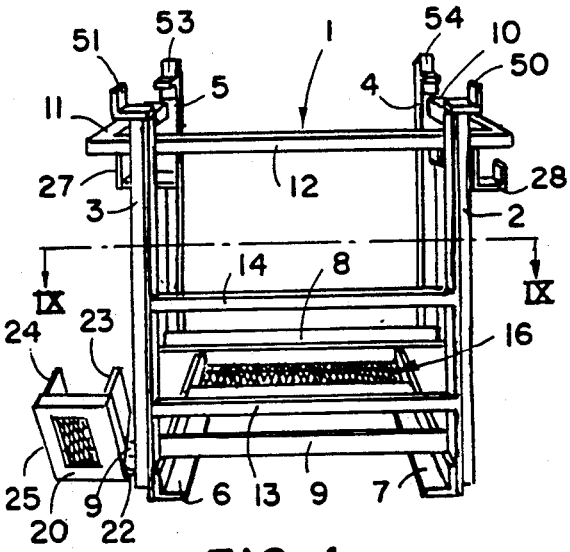
FIG. 1 is a front, elevational, perspective view of a scaffolding rack constructed according to the teachings of the present invention.
Figure 2:
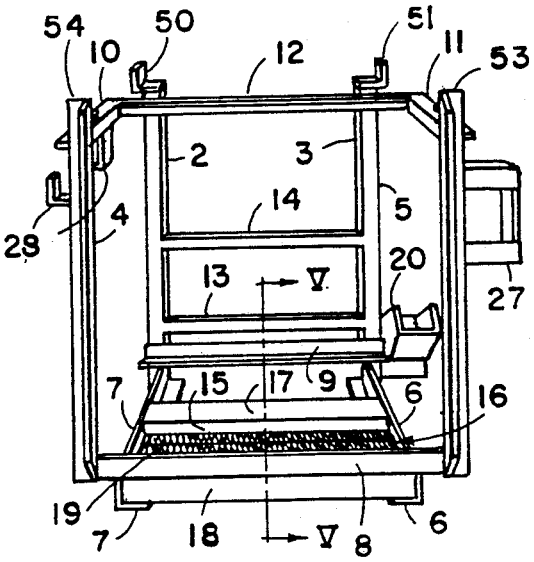
FIG. 2 is a rear, elevational, perspective view of the rack of FIG. 1.

In the previous and following description, it should be understood that the term "front" is used to designate that side of the rack in which the fork of a lift tractor is inserted, it being understood that "rear" is the side opposite the front.

Referring now to the drawings in greater detail, reference numeral 1 designates the entire rack assembly which includes the four upright posts 2, 3, 4 and 5 forming substantially the corners of the rack. The two front posts 2 and 3 are spaced a distance less than the distance of the spacing between the rear posts 4 and 5. This is most evident in FIG. 9 since the other figures generally are perspectives. This spacing is for the purpose of holding the frames 30 in a position with their legs 31 and 32 extending between the rear posts 4 and 5 and outside of the front posts 2 and 3, as illustrated by the phantom lines in FIG. 9 and also in FIGS. 6 and 7.

Figure 4:
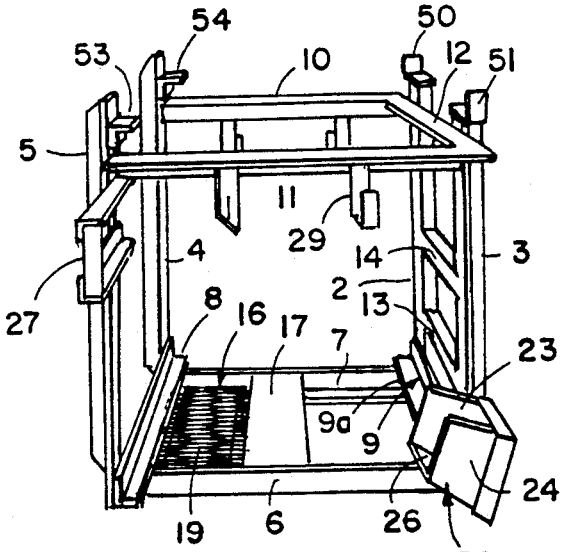
FIG. 4 is a side, elevational, perspective view of the other side of the rack of FIGS. 1, 2 and 3.

The posts 2, 3, 4, and 5 are supported at their lower ends by the side rails 6 and 7 and the end rails 8 and 9. The side rails 6 and 7 and end rails 8 and 9 are arranged so that there is an incline or pitch to the scaffold frames 32 when placed and stored on the rack. This is accomplished, as best disclosed in FIGS. 4, 6 and 7, by resting the legs 31 and 32 on end rail 8 and horizontal support member 35 on the horizontal flange 9*a* of end rail 9. The upper ends of the posts 2, 3, 4 and 5 are supported by the side rails 10 and 11 and the front rail 12. The rear is open so as to permit the frames 30 to be withdrawn therethrough. The front posts are also supported by the intermediate rails 13 and 14 which also provide a barrier or stop to protect the frames 30 from the front of the tractor in the event the fork of the tractor is short.

Figure 3:
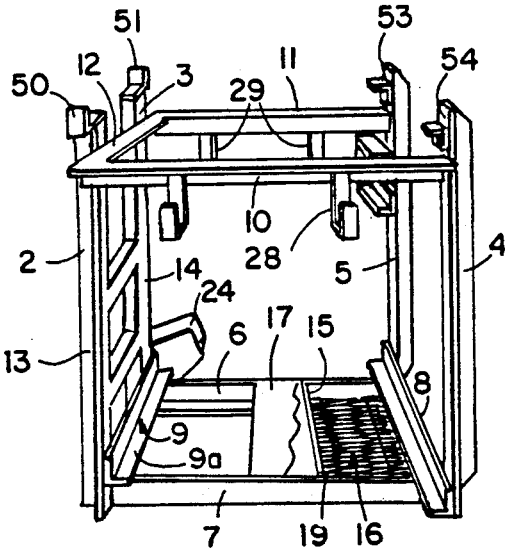
FIG. 3 is a side, elevational, perspective view of one side of the rack of FIGS. 1 and 2.
Figure 5:
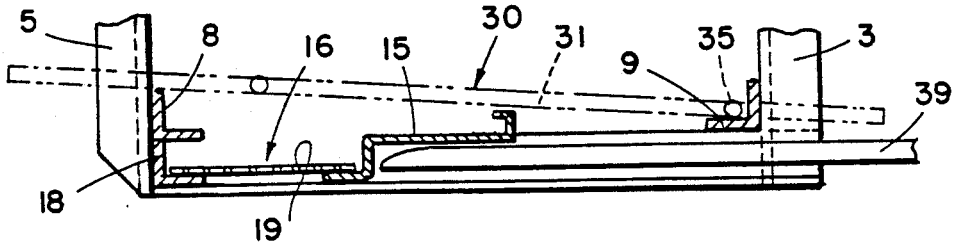
FIG. 5 is a cross-sectional, partial view taken along the plane V—V of FIG. 2.

Primarily, the frames 30 are protected from the tractor by providing a stop 15 (FIGS. 3 and 5). FIG. 5 discloses the fork 39 abutting the stop 15 which also forms a wall for a bin 16 provided to store wear plates used for the purpose of preventing the legs of the scaffolding from sinking into the soil. As disclosed in FIG. 5, the wall has a plate or flange 17 extending toward the front posts 2 and 3, providing sufficient surface area for the fork 40 to lift the entire rack. The bin 16 is formed by the L-shaped member 18 extending between the two side rails 6 and 7. The floor 19 of the bin 16 is expanded metal, thereby providing a pervious bottom through which sand and other debris which may have collected on the base plates can fall to minimize the amount of debris collected in the bin 16.

The rack assembly 1 provides two means for supporting the braces 33 (FIGS. 6, 7 and 8). The first is provided for by extending the posts above the rails 10, 11 and 12, or in other words, mounting the rails 10, 11 and 12 below the ends of the posts 2, 3, 4 and 5. This provides a means for placing the braces 33 so as to rest on the rails 10 and 11 while at the same time being prevented from sliding off by reason of the posts extending above the rails 10 and 11.

Another means for storing the braces 33, which is the preferred means, is the provision for a basket 20 secured to the lower, rear corner of the rack, the means for securing being the extension of the lower rail 9 and a welded plate 22 to the lower end of the post 3. The basket 20, having the sides 23 and 24, the end wall 25 and bottom wall 26, provides a support for the lower end of the braces 33. The substantially open top and front provide for easy insertion and removal of the brace 33 from the basket 20. Working in conjunction with basket 20 is the C-shaped support 27 secured near the upper end of the post 5 so to in effect provide a ring-like support through which the braces 33 can extend, as disclosed in FIGS. 6, 7 and 8. In this position, the braces 33 are in position for the worker located at the rear of the rack assembly 1 to easily remove a brace 33 since the brace 33 is immediately and conveniently in position for removal by the worker. It should be understood that FIGS. 6 and 7 show only one brace 33 in position for illustration purposes only. Normally a number of such braces 33 are held in the basket 20 and ring-line member 27 as illustrated by FIG. 8.

Another feature of my invention is a provision for supporting triangular-shaped braces or brackets 34 on either side of the rack by means of the hook-shaped brackets 28 and 29. Hook 28 is mounted on the side rail 10 while hook 29 is mounted on the side rail 12, thus providing a means on either side of the rack for supporting scaffolding components such as the triangular-shaped braces 34. Obviously, other shapes of braces and the like can be supported on the hook-shaped supports 28 and 29.

One other feature of my invention is the provision for the chains 40 and 41 secured to the posts 2 and 3, respectively, by the eye bolts 42 and 43. These chains are provided to connect to the lift of the tractor so as to prevent the rack from tipping rearwardly, i.e., away from the front posts 2 and 3. In fact, generally the fork is pitched toward the tractor so as to tip the entire rack slightly toward the tractor whereby any shifting of the frames 30 is toward the tractor so as to prevent sliding of the frames 30 out of the rack.

OPERATION

Having described my invention, the operation should become quite clear. As disclosed in FIG. 8, the frames are stacked one on another on their sides with the legs 31 and 32 located outside of the front posts 2 and 3, and inside the rear posts 4 and 5. As disclosed in FIGS. 5, 6 and 7, the legs 31 and 32 of the first two or three scaffold frames 30 rest on the end rail 8 and the horizontal support member 35 of the first scaffold frame rests on the flange 9*a* of rail 9. The remaining scaffold frames are thus inclined or pitched toward the front posts 2 and 3 and their horizontal support members 35 abut against the front posts 2 and 3. When the rack is stored, the frames are generally held on a slightly inclined plane so there is no tendency for the frames to slide off the rack. When the rack is lifted by the fork lift, the fork lift is also pitched to tip the rack assembly 1 slightly toward the tractor, i.e., towards the front of the rack. This also creates a force causing the horizontal support members 35 of the frames above the first two or three frames to abut against the front posts 2 and 3 and to firmly hold the frames 30 on the rack. Nevertheless, the frames can be easily removed by a worker stationed at the rear of the rack when erecting a scaffold by sliding the frame 30 between the rear posts 4 and 5 and the worker can easily stack the frames 30 on the rack when dismantling the scaffold.

A worker stationed at the rear of the rack has ready access to the braces 33 located in the basket 20 and the ring-like support 27. The worker merely has to slide the brace 33 out of the bin 20 and support 27.

Other scaffold side hooks such as those designated by 34 also are easily accessible by reaching over to the side of the rack and removing the same when erecting is taking place and when the scaffolding is being dismantled they can be easily placed on the hook supports 28 and 29.

When the scaffolding components are to be stored at a storage site, the completely filled racks can be stored one on another by means of the brackets 50, 51, 52 and 53. Thus, the amount of space required for storing the scaffolding components is greatly reduced.

While a particular embodiment of the present invention has been shown and described, it will be obvious to those skilled in the art that various changes and modifications may be made without departing from the spirit of the invention, particularly in its broader aspects. Therefore, the appended claims are intended to cover all such changes and modifications as fall within the true spirit and scope of the invention.

The embodiments of the invention in which an exclusive property or privilege is claimed are defined as follows.

1. A scaffold rack for supporting a plurality of scaffolding components including scaffolding frames constructed of parallel spaced legs wherein the scaffold rack comprises:

four upright corner posts including two front and posts and two rear end posts;

first side rails extending between one front end post and one rear end post;

second side rails extending between the other of said front and rear end posts;

front end rails extending between the two front end posts;

at least one rear end rail extending only between the lower ends of said two rear end posts;

said posts and rails forming a rigid upstanding frame assembly with an open end for receiving and stacking said scaffolding frames;

said front end posts being spaced a distance front each other less than the spaced distance between said rear end posts whereby when the scaffold frames each having parallel legs are stacked on their sides with the legs of one frame resting above the legs of another frame, the legs at one end thereof are located outside the front end posts and at the other end thereof are located inside the rear end posts;

a basket-like member mounted at one lower corner of one of the sides of said frame at one of the front or rear posts, and a ring-like member mounted on said one side of said frame at an upper corner of said frame at the other of said front or rear posts whereby a plurality of elongated braces can be supported along the said one side of said frame with the lower ends of said braces extending along the one side into said basket-like member and the upper ends of said braces extending through said ring-like member.

2. A scaffold rack for supporting a plurality of scaffolding components including scaffolding frames constructed of parallel spaced legs wherein the scaffold rack comprises:

four upright corner posts including two front end posts and two rear end posts;

first side rails extending between one front end post and one rear end post;

second side rails extending between the other of said front and rear end posts;

front end rails extending between the two front end posts;

at least one rear end rail extending only between the lower ends of said two rear end posts;

said posts and rails forming a rigid upstanding frame assembly with an open end for receiving and stacking said scaffolding frames;

said front end posts being spaced a distance from each other less than the spaced distance between said rear end posts whereby when the scaffold frames each having parallel legs are stacked on their sides with the legs of one frame resting above the legs of another frame, the legs at one end thereof are located outside the front end posts and at the other end thereof are located inside the rear end posts;

the lowermost front end rail being spaced a distance above the lower ends of said front posts to permit the fork of a lift tractor to pass under said front end rails;

a bin for storing base plates located along the rear of said frame assembly and at a level lower than the said front end rails and adjacent said rear posts; said bin being spaced rearwardly of the front posts a sufficient distance so as to not interfere with the fork of a lift tractor passing under said front end rails for lifting said rack.

3. The rack of claim 2 in which said bin includes a floor constructed of pervious material through which the debris such as sand can pass.

4. A scaffold rack for supporting a plurality of scaffolding components including scaffolding frames constructed of parallel spaced legs wherein the scaffold rack comprises:

four upright corner posts including two front end posts and two rear end posts;

first side rails extending between one front end post and one rear end post;

second side rails extending between the other of said front and rear end posts;

front end rails extending between the two front end posts;

at least one rear end rail extending only between the lower ends of said two rear end posts;

said posts and rails forming a rigid upstanding frame assembly with an open end for receiving and stacking said scaffolding frames;

said front end posts being spaced a distance from each other less than the spaced distance between said rear end posts whereby when the scaffold frames each having parallel legs are stacked on their sides with the legs of one frame resting above the legs of another frame, the legs at one end thereof are located outside the front end posts and at the other end thereof are located inside the rear end posts; the lowermost front end rail being spaced a distance above the lower ends of said front posts to permit the fork of a lift tractor to pass under said front end rails;

a bin for storing base plates located at a level lower than the said front end rails and adjacent said rear posts;

said bin being formed along the rear of said frame and including a front bin wall extending between the side rails of said frame, said front bin wall being a rigid member spaced a predetermined distance from said front of said rack assembly and forming a stop to limit the distance the fork of a lift tractor can extend under said frame.

5. A scaffold rack for supporting a plurality of scaffolding components including scaffolding frames constructed of parallel spaced legs comprising four upright corner posts including two front end posts and two rear end posts;

first side rails extending between one front end post and one rear end post and defining a first side of said rack;

second side rails extending between the other of said front and rear end posts and defining a second side of said rack;

front end rails extending between the two front end posts;

at least one rear end rail extending only between the lower ends of said two rear end posts;

said posts and rails forming a rigid upstanding frame assembly with an open end for receiving and stacking said frames; and a basket-like member mounted at one lower end of one of the front or rear posts on either said first or second side of said rack and extending in an outwardly direction away from one of said first or second sides; a ring-like member on the same said first or second side as said basket-like member and mounted at an upper end of the other of said front or rear post on said side and extending in an outwardly direction away from said side whereby a plurality of elongated braces can be supported diagonally along the outside of said first or second side of said frame with the lower ends of said braces located in said basket and the upper ends of said braces extending through said ring-like member.

6. The rack of claim 5 in which the lowermost front end rail is spaced a distance above the lower ends of said front posts to permit the fork of a lift tractor to pass under said front end rails; and a bin for storing wear plates located at a level lower than the said front end rails and adjacent said rear posts.

7. The rack of claim 6 in which said bin includes a floor constructed of pervious material through which the debris such as sand can pass.

8. A scaffold rack for supporting a plurality of scaffolding components including scaffolding frames constructed of parallel spaced legs wherein the scaffold rack comprises:

four upright corner posts including two front end posts and two rear end posts;

first side rails extending between one front end post and one rear end post;

second side rails extending between the other of said front and rear end posts;

front end rails extending between the two front end posts;

at least one rear end rail extending only between the lower ends of said two rear end posts;

said posts and rails forming a rigid upstanding frame assembly with an open end for receiving and stacking said frames; and a basket-like member mounted at one lower corner of said frame and one one side thereof and a ring-like member mounted at an upper corner of said frame on the same side whereby a plurality of elongated braces can be supported at the side of said frame with the lower ends of said braces extendign into said basket-like member and the upper ends of said braces extending through said ringlike member; the lowermost front end rail being spaced a distance above the lower ends of said front posts to permit the fork of a lift tractor to pass under said front end rails;

a bin for storing wear plates located along the rear of said frame assembly and at a level lower than the said front end rails and adjacent said rear posts;

said bin being formed at the rear of said frame and including a front being wall extending between the side rails of said frame nearest said front, said front bin wall being a rigid member forming a stop to limit the distance the fork of the lift tractor can extend under said frame.

9. The rack of claim 5 in which an L-shaped bracket is supported on one of the rails for holding scaffolding components such as triangular side hooks.

10. The rack of claim 5 in which chains are secured to the front posts for attaching to the mast of a lift tractor.

11. The scaffold rack of claim 5 in which brackets are provided at the tops of said posts to facilitate stacking of one rack on another.

12. A scaffolding rack for supporting a plurality of scaffolding components including scaffolding frames constructed of parallel spaced legs wherein the scaffold rack comprises:

four upright corner posts including two front end posts and two rear end posts;

first side rails extending between one front end post and one rear end post;

second side rails extending between the other of said front and rear end posts;

front end rails extending between the two front end posts;

at least one rear end rail extending only between the lower ends of said two rear end posts;

said posts and rails forming a rigid upstanding frame assembly with an open end for receiving and stacking said frames;

said lowermost front end rail being spaced a distance above the lower ends of said front posts to permit the fork of a lift tractor to pass under said front end rails; and a bin for storing base plates located along the rear of said frame assembly at a level lower than the said front end rails, adjacent said rear posts and spaced from said front end rails;

said bin being spaced rearwardly of the front posts a sufficient distance so as to not interfere with the fork of a lift tractor to pass under said front end rails and lift said rack.

13. The rack of claim 12 in which the floor of said bin is constructed of pervious material through which the debris such as sand can pass.

14. A scaffolding rack for supporting a plurality of scaffolding components including scaffolding frames constructed of parallel spaced legs where the scaffold rack comprises:

four upright corner posts including two front end posts and two rear end posts;

first side rails extending between one front end post and one rear end post;

second side rails extending between the other of said front and rear end posts;

front end rails extending between the two front end posts;

at least one rear end rail extending only between the lower ends of said two rear end posts;

said posts and rails forming a rigid upstanding frame assembly with an open end for receiving and stacking said frames;

said lowermost front end rail being spaced a distance above the lower ends of said front posts to permit the fork of a lift tractor to pass under said front end rails; and a bin for storing base plates located along the rear of said frame assembly and at a level lower than the said front end rails, adjacent said rear posts and spaced from said front end rails;

said bin being formed at the rear of said frame with the front wall of said bin extending between the side rails of said frame, said front wall of said bin being a rigid member spaced a predetermined distance from said front of said rack assembly and forming a stop to limit the distance the fork of a lift tractor can extend under said frame.

15. The rack of claim 14 in which an L-shaped bracket is supported on at least one of the upper side rails for holding scaffolding components such as triangular side hooks.

* * * * *

UNITED STATES PATENT AND TRADEMARK OFFICE

CERTIFICATE OF CORRECTION

PATENT NO. : 5,018,629

DATED : May 28, 1991

INVENTOR(S) : Robert Lamar

It is certified that error appears in the above-identified patent and that said Letters Patent is hereby corrected as shown below:

Col 5, claim 1, line 31;
"front and" should be --front end--;

Col. 5, claim 1, line 44;
"front each" should be --from each--;

Col. 7,claim 8, line 66;
"one one" should be --on one--;

Col. 8, claim 8, line 2;
"extendign" should be --extending--;

Col. 8, claim 14, line 13;
"front being" should be --front bin--.

Signed and Sealed this

Twelfth Day of January, 1993

*Attest:*

DOUGLAS B. COMER

*Attesting Officer*

*Acting Commissioner of Patents and Trademarks*